US007814972B2

(12) United States Patent
Angman et al.

(10) Patent No.: US 7,814,972 B2
(45) Date of Patent: Oct. 19, 2010

(54) WIRELINE ENTRY SUB

(75) Inventors: Per G. Angman, Calgary (CA); Tommy M. Warren, Coweta, OK (US)

(73) Assignee: Tesco Corporation, Houston, TX (US)

( * ) Notice: Subject to any disclaimer, the term of this patent is extended or adjusted under 35 U.S.C. 154(b) by 164 days.

(21) Appl. No.: 12/014,001

(22) Filed: Jan. 14, 2008

(65) Prior Publication Data

US 2008/0196904 A1 Aug. 21, 2008

Related U.S. Application Data

(60) Provisional application No. 60/884,771, filed on Jan. 12, 2007.

(51) Int. Cl.
*E21B 19/06* (2006.01)

(52) U.S. Cl. ..... 166/77.52; 166/77.1; 166/117.5

(58) Field of Classification Search ..... 166/77.1, 166/77.52, 117.5, 241.5
See application file for complete search history.

(56) References Cited

U.S. PATENT DOCUMENTS 4,482,013 A * 11/1984 Fulkerson ..... 166/118
4,681,162 A 7/1987 Boyd
5,188,173 A * 2/1993 Richardson et al. ..... 166/77.1
5,960,881 A 10/1999 Allamon et al.
6,044,690 A * 4/2000 Williams ..... 73/40.5 R
6,202,764 B1 3/2001 Ables et al.
6,763,898 B1 * 7/2004 Roodenburg et al. ..... 175/7
6,913,084 B2 7/2005 Boyd
7,533,732 B2 * 3/2007 Angman et al. ..... 166/50
7,575,061 B2 * 5/2009 Boyd ..... 166/385
2004/0216924 A1 * 11/2004 Pietras et al. ..... 175/57
2006/0032638 A1 2/2006 Giroux et al.
2006/0248985 A1 * 11/2006 Bangert ..... 81/57.15
2008/0059073 A1 3/2008 Giroux et al.

FOREIGN PATENT DOCUMENTS

GB 2223253 4/1990

* cited by examiner

*Primary Examiner*—David J Bagnell
*Assistant Examiner*—Catherine Loikith
(74) *Attorney, Agent, or Firm*—Bracewell & Giuliani LLP

(57) ABSTRACT

A wireline entry sub includes a body having an upper end, a lower end and a longitudinal, center axis therebetween. The body is adapted for connection below a top drive to a wellbore string of tubulars. A slot on the body has a depth from a body outer surface to at least the longitudinal center axis for receiving a sheave. A wireline entry port extends through the body from the slot to the lower end. The lower end of the wireline entry sub is adapted to be secured to the string of tubulars, with the weight of the tubulars passing through the wireline entry sub.

18 Claims, 8 Drawing Sheets

WIRELINE ENTRY SUB

FIELD OF THE INVENTION

The invention relates to an oil field tool for handling wireline and, in particular, a wireline entry sub.

BACKGROUND

Conventional oil field casing may be used as the drillstring for drilling oil and gas wells to simultaneously drill and case the wellbore. Once the wellbore is drilled to the desired depth, the casing is cemented into the earth without withdrawing it from the wellbore. A retrievable drilling assembly, including a bit and borehole enlarging tool, may be attached to the bottom end of the casing for drilling. This drilling assembly often includes other components such as mud motors, MWD collars, LWD collars, non-magnetic drill collars, steel drill collars, and stabilizers.

Once the casing is drilled to the desired casing setting depth, the drilling BHA is retrieved from the casing with a wireline before the casing is cemented in place. In some cases the BHA must be retrieved and replaced before the casing is drilled to its terminal depth, for example to replace a worn drill bit or to replace some other failed component in the BHA. A provision must be made for the wireline to be run through the casing to retrieve the BHA. It is often advantageous to circulate drilling fluid down the ID of the casing while the wireline is being run and the BHA recovered to assure that any influx of formation fluids is circulated out of the well in a controlled manner. It is also advantageous to reciprocate the casing while the BHA is being recovered so that the casing does not become stuck in the borehole. A swivel or a power drive assembly and a casing drive system may be attached to the casing in order for circulation and reciprocation of the casing to be accomplished. A power drive assembly such as a top drive is often used to rotate the casing for drilling. The casing may be attached to the top drive with a tubular gripping device such as a casing drive system that grips the top of the casing without screwing into its upper threaded connection. The casing drive system also includes seals to contain the drilling fluid so that it can be circulated down the inside diameter of the casing to flush cuttings away from the drill bit and up the annulus between the casing and the borehole wall.

The drilling rig used to drill with casing may be a specially designed rig that facilitates the efficient operation of the wireline for running and retrieving the drilling BHA. The rig also must be equipped with a wireline unit that is capable of handling the drilling BHAs. For rigs designed for casing drilling, this wireline unit may be provided as an integral part of the rig.

Access for the wireline is provided through the top of the swivel, which may be incorporated as an integral part of the top drive. The wireline access through the top of the swivel may be facilitated by utilizing a split crown block and split traveling block. Split blocks are ones where the sheaves used for carrying the drilling line are divided into two groups spaced laterally apart. The split crown arrangement allows a wireline sheave to be hung at the crown of the rig so the wireline can be aligned with the central axis of the drillstring. The split traveling block provides room for a wireline stripper assembly and wireline BOP to be attached to the top of the swivel to prevent the pressurized drilling fluid from escaping around the wireline as it is being run into and pulled from the casing. In some situations, it may be sufficient to provide only a split traveling block as the fleet angle from having the crown sheave offset slightly from the central axis of the drillstring.

The drilling BHA may be quite heavy and weigh as much as 30,000 pounds. A large braided cable, for example ¾" in diameter, may be required to support this much weight and the sheaves used with such a cable are relatively large in diameter, for example 30" in diameter. It is important that the sheaves and wireline pressure control equipment be positioned so that the wireline can enter the casing along its central axis. Otherwise, the cable will exert lateral forces on the casing or other equipment and will quickly cut into the equipment as it is run into and out of the well.

In some situations, it may be advantageous to use a drilling rig that is designed specifically for drilling with casing when one is available. Often such a rig may not be available or only a portion of the well may be drilled with casing so that it may be more convenient to use a conventional rig.

There are only a few drilling rigs in the current fleet of rigs available for use in drilling oil and gas wells that are equipped as described above for using casing as the drillstring. While it is possible to modify any drilling rig to include the facilities needed to handle the wireline when drilling with casing, most conventional drilling rigs do not include split crown blocks and split traveling blocks to facilitate wireline access along the central axis of the drillstring. The time required to modify the rig to accommodate these parts and the capital cost of the modifications may not be justified when the rig is used to drill only a portion of a well with casing. Furthermore, the owner of the rig may not allow structural changes to be made to the rig. This is particularly true for expensive offshore rigs.

There are devices described in the prior art for providing wireline access to the ID of a drillstring. For example, U.S. Pat. No. 6,202,764 describes a wireline entry sub that can facilitate wireline use on a rig. Although such a wireline entry sub has been described, it is desirable that an improved sub be provided.

For example, in some cases, particularly for offshore rigs, the time and effort required for converting a rig so that it becomes capable of handling a wireline may be a problematic issue.

SUMMARY

In accordance with a broad aspect of the present invention, there is provided a wireline entry sub, comprising: a body including an upper end, a lower end and a longitudinal, center axis therebetween; a wireline passage extending through the body from an entry port to a lower opening adjacent the lower end; and a tubular supporting mechanism secured on the lower end, the tubular supporting mechanism including a sleeve axially and rotatably moveable on the body, the sleeve including a threaded interval thereon for threaded engagement with a tubular segment to be supported.

In accordance with another broad aspect of the present invention, there is provided a wireline entry sub, comprising: a body including an upper end, a lower end and a longitudinal, center axis therebetween; a wireline passage extending through the body from an entry port to a lower opening adjacent the lower end; a wireline blowout preventer integrated into the body, including an annular ram closable around the wireline and a shear ram closable to cut the wireline; a wireline packoff above the blowout preventer; and a tubular supporting mechanism secured on the lower end, the tubular supporting mechanism including a sleeve axially and rotatably moveable on the body, the sleeve including a threaded interval thereon for threaded engagement with a tubular segment to be supported.

In accordance with another broad aspect of the present invention, there is provided a method for installing a wireline entry sub onto a tubular segment, the wireline entry sub including a body having an upper end, a lower end and a longitudinal, center axis therebetween and a wireline passage extending through the body from an entry port to open adjacent the lower end and the tubular segment being accessible as a stump secured by a drilling rig and the stump including an open upper end, the method comprising: providing a sleeve secured for axial and rotational movement on the wireline entry sub lower end; and rotating the sleeve about the lower end substantially without rotating the lower end of the wireline entry sub to thread the sleeve into the stump.

In accordance with another broad aspect of the present invention, there is provided a wireline entry sub, comprising: a body including an upper end, a lower end and a longitudinal, center axis therebetween; a wireline passage extending through the body from an entry port to a lower opening adjacent the lower end; a tubular supporting mechanism secured on the lower end; and a skid frame secured on a side of the body including a bottom portion and an arm extendable from the bottom portion to a position alongside the lower end of the wireline entry sub.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Although many different embodiments of the invention are possible, with reference to the figures as appropriate. It is understood that while the invention is described below being employed with wireline (whether "slick line", braided cable, electric line, etc.), the invention is not limited to use with wireline, rather other small diameter conduits such as coiled tubing may be used with it as well.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
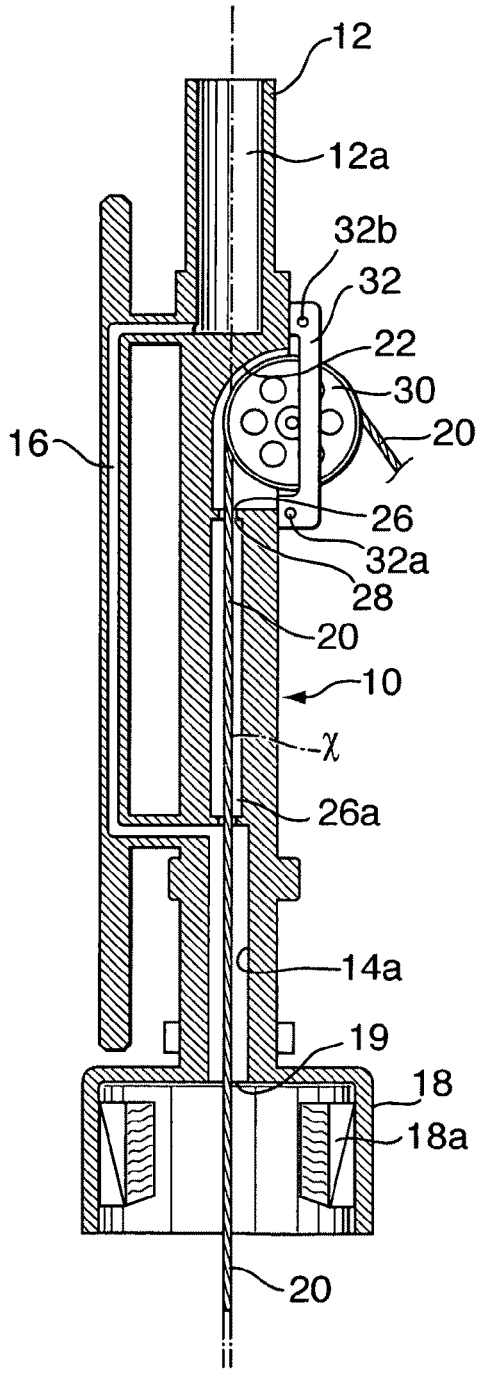
FIG. 1 is a schematic sectional view along the center axis of one embodiment of a wireline entry sub according to one aspect of the present invention.

FIG. 1 shows a wireline entry sub 10 according to one aspect of the present invention. Entry sub 10 is connectable between a top drive and a well bore tubular during use to permit the use of a wireline during a well bore operation.

Wireline entry sub 10 includes a body including an upper collar 12, a lower end and a longitudinal, center axis x therebetween. In the illustrated embodiment, upper collar 12 has a bore 12*a* therethrough and the lower end has a bore 14*a* therethrough. A fluid passage 16 extends to fluidly connect upper collar bore 12*a* and lower end bore 14*a*. Fluid passage 16 therefore provides a fluid flow path along the length of entry sub 10, which permits fluid circulation through the entry sub, from the top drive above the entry sub to the well bore tubular connected below the entry sub, during use. While fluid passage 16 is shown extending through a line spaced from the body of the sub, it is to be understood that a fluid passage may be bored or otherwise formed through the body if that is desired.

Entry sub 10 is formed to accept a wireline 20 passing from a source such as storage reel (for example item 50 in FIG. 2) through entry sub 10 to, thereafter, pass downhole. Entry sub 10 has an opening formed as a slot 22 extending from the sub body outer surface into the sub body material between upper collar 12 and the lower end. Slot 22 extends a depth into the sub at least ½ the sub body's effective outer diameter so that slot 22 is open to the sub center axis x. A wireline entry port 26 is formed in slot 22, for example at its base, and connects to a passage 26*a* that extends through the entry sub body toward the lower end. Wireline passage 26*a* in some embodiments may join up with the sub's fluid passage or with the bore through lower end. In the illustrated embodiment, fluid passage 16 connects with passage 26*a* and together these passages open into bore 14*a*.

A seal assembly 28 may be mounted in port 26 for sealing about a wireline that may be installed to pass therethrough. A wireline passage aperture through seal assembly 28 may be substantially concentric with the center axis x of sub 10.

A sheave 30 may be connected to entry sub 10 in association with slot 22. Sheave 30 directs wireline into position for passing through port 26 and any seal assembly 28 therein. Wireline 20 passes over sheave 30, through seal assembly 28, through passage 26*a* and out through the lower end before passing downhole. Sheave 30 is positioned and/or configured such that wireline 20 roved over it comes off adjacent port 26 substantially aligned with the center axis x of the lower end. In the one embodiment, sheave 30 may be connected to entry sub 10 via a bracket 32. Bracket 32 may include pivotal connections 32*a* and releasable connections 32*b* to permit the sheave mounted thereon to be pivoted out of slot 22 away from port 26 to facilitate installation of a wireline about the sheave and through port 26.

Sheave 30 may take various forms and, for example, may include one or more idler sheaves and/or one or more traction generating members such as driven sheaves for generating a pull force on the wireline. If desired, any such driven sheaves may be driven by connection, through gears, drive shaft, hydraulic connections, etc. from the top drive. In another embodiment, entry sub 10 may include a wireline pulling device other than sheave 30 for applying a pulling force to the wireline.

Upper collar 12 may include an inside or an outside surface formed to be gripped by a tubular gripping device. Tubular gripping devices can vary significantly in form and function. Tubular gripping devices often operate without reliance on threaded connections and may often include an internal and/or external tubular gripping mechanism. Unlike connections effected by threaded connections, tubular gripping devices can operate without requiring significant relative rotational movement between the gripping device and the item to be gripped. Gripping devices may include packer-type systems that expand to grip an inner or an outer diameter of the tubular to be gripped. Tubular gripping mechanisms may alternately or in addition include teethed dies that can be driven to grip and bite into the tubular. These gripping mechanisms may be driven mechanically, hydraulically, by motors, etc. Generally, gripping mechanisms driven by hydraulics can be operated quickly and without requiring significant movement of the tool on which the mechanism is mounted. Some gripping devices for casing-type tubulars, for example, are described in U.S. Pat. No. 6,311,792, issued November 2001 and International application WO00/05483, published February 2000, both to TESCO Corporation.

With consideration to the foregoing, the form of upper collar 12 can also vary significantly depending on the form of tubular gripping device to be used in order to be effectively gripped thereby. In one embodiment, upper collar 12 can conveniently be formed to resemble the necessary structural features of a tubular normally intended to be gripped by the tubular gripping device that permit entry sub 10 to be gripped by the tubular gripping mechanism. For example, the inner or the outer surface of upper collar 12 may be sized, configured and/or include material suitable for gripping by the tubular gripping device to be used.

In some embodiments, pipe elevators may be provided for use with tubular gripping devices. Elevators operate to catch on a shoulder formed on an outer surface of the tubular to be gripped. Thus, upper collar 12 may be formed to include an upset to permit handling by a pipe elevator, if desired.

Alternately or in addition, the lower end may have secured thereto, or formed integral therewith, a tubular support device 18 including a tubular support mechanism for securing the entry sub and a tubular segment (for example shown as segment 46 in FIG. 2) together, so that the entry sub can support the weight of the tubular segment and hold the tubular segment so that wireline from the entry sub may pass therein. The tubular segment may be independent or connected to other tubulars in a tubular string. Tubular support device 18 may operate, for example, by catching on, engaging or gripping the tubular segment. To be particularly useful, tubular support device 18 may be capable of connecting to the tubular segment without rotational manipulation of the body relative to the tubular. Such a non-rotating connection may include for example a tubular gripping mechanism, a threaded sleeve or a catch-type mechanism, employing elevator-type support.

In the illustrated embodiment, tubular support device 18 is a tubular gripping device. Tubular gripping devices may vary, as was described in detail hereinabove. The present device for example is configured to externally grip a tubular using teethed slips 18*a*. In the illustrated embodiment, device 18 is connected at the lower end of the entry sub and includes a port 19 therein, which may extend along axis x, through which a wireline can pass out from the bottom end of the device. Port 19 communicates with bore 14*a*, which in turn is in communication with fluid passage 16 such that fluid from the entry sub can pass through port 19 and out into any tubular gripped by device 18.

Figure 2:
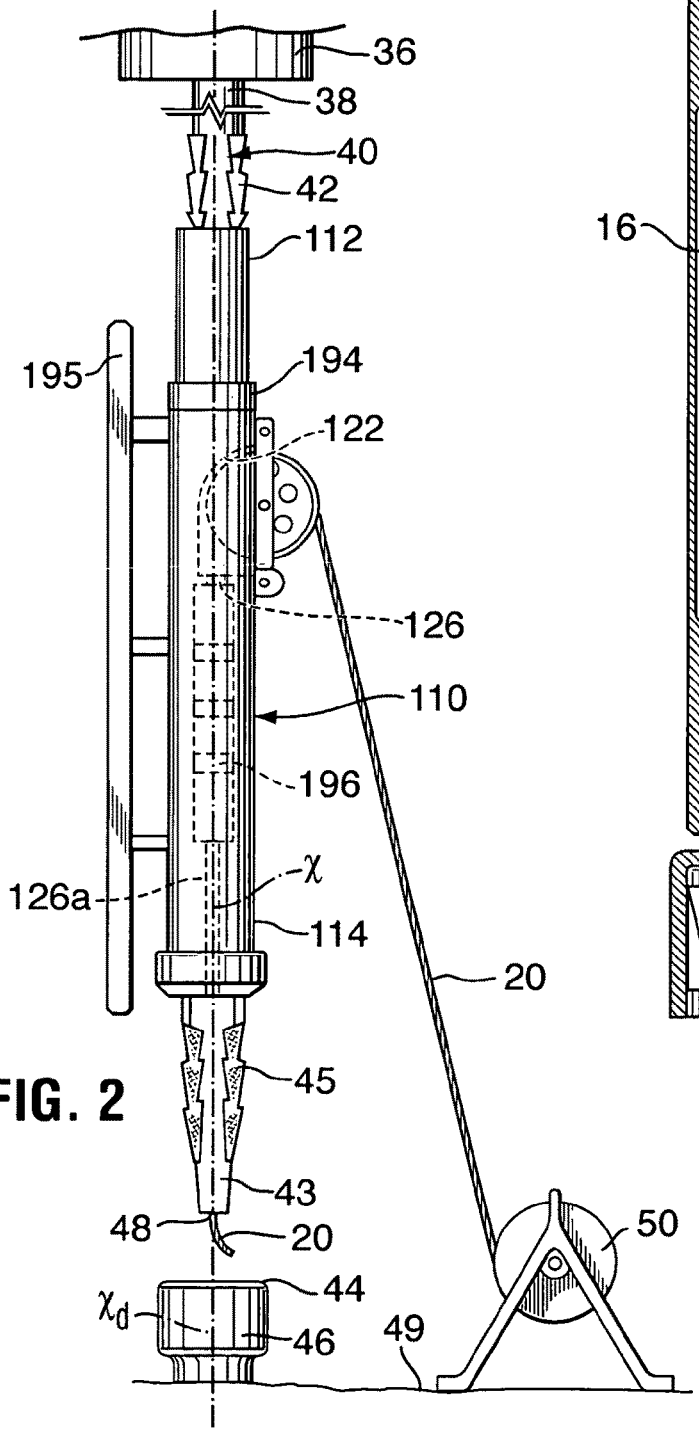
FIG. 2 is a side elevation view of a well process assembly according to the present invention in an operational setting with some internal components shown in phantom.

FIG. 2 shows one of many possible embodiments of a well process system for manipulating tubulars in a well bore. The well process system includes a wireline entry sub 110 having a body including an upper end 112, a lower end 114 and a longitudinal, center axis x therebetween, an opening 122 provides access to the longitudinal center axis x of the body and a wireline entry port 126 positioned coincident with the center axis x. Port 126 opens into a passage 126*a* extending through the body from the opening adjacent the lower end 114 in a position substantially along axis x. The well process system further includes a vertically movable power drive assembly 36, such as a top drive, including a longitudinally extending output shaft 38 movable vertically with the power drive assembly and an upper tubular gripping device 40 coupled to output shaft 38. Upper tubular gripping device 40 includes a spear carrying a hydraulically driven gripping mechanism, indicated generally at 42, including toothed dies drivable to grip and support upper end 112 of the wireline entry sub. To be gripped by upper tubular gripping device 40, upper end 112 can be formed to resemble a tubular that device is normally intended to grip. For example, upper end 112 may have a tubular form with an inner diameter sized to accept an end of the gripping device with mechanism 42 mounted thereon and may include an inner wall formed to be gripped by the dies of mechanism 42. Upper tubular gripping device 40 may also include a fluid passage therethrough to convey fluid to entry sub 110 and thereafter downhole. In such an embodiment, a seal may be provided in an interface between device 40 and sub 110, for example, carried on device 40.

In the illustrated embodiment, a lower tubular gripping device 43 is shown coupled to lower end 114 of the wireline entry sub. The lower tubular gripping device includes a tubular gripping mechanism 45 selected to grip and support a top end 44 of a tubular segment 46. Lower tubular gripping device 43 also includes a port 48 opening adjacent its bottom end. Port 48 provides access to a bore 48*a* through device, which is aligned with and communicates to passage 126*a*. As such, during operation a wireline can pass from passage 126*a* through device 43 and into the top end of the tubular segment.

The well process system including sub 110 may be used in a drilling rig (only the floor 49 of which is shown) to allow a wireline 20 to be run in hole. Wireline 20 enters sub 110 through wireline entry port 126, extends through passage 126*a* down through the sub and lower tubular gripping device 43 to exit through port 48 after which it can pass into tubular segment 46, which may be the upper most segment of a tubular string such as a drill string or a casing string. The well process system permits a well to be converted for use with a wireline very quickly and without extensive modifications to a drilling rig. In particular, conversion of a rig to handle wireline requires only that the top drive and upper tubular gripping device 40 release the upper most tubular segment, for example, leaving it supported in the drill floor 49, for example in a rotary table or in a spider and slips. Then sub 110 is engaged by upper tubular gripping device 40, which may be as easy as hydraulically driving gripping dies to engage an outer diameter or an inner diameter of upper end 112 so that the wireline entry sub is moveable with and positioned below the top drive assembly. Either before or after sub 110 is installed on upper tubular gripping device 40, wireline storage reel 50 is brought onto or adjacent the rig and wireline 20 is inserted into sub 110. Once wireline 20 extends through port 48 (or out through the bottom end of the entry sub, when no lower device 43 is used), wireline tools may then be connected to wireline 20 and lowered into tubular 46 supported by the drilling rig.

In the embodiment of FIG. 2, if no lower device 43 is used, wireline entry sub 110 may be connected by threaded engagement to tubular 46. In such case, the wireline entry sub may be threaded to the stump of tubular 46 generally after the wireline tools are connected to the wireline and either before or after the sub's upper end is brought into engagement with upper tubular gripping device 40. A swivel connection may be of use in such an embodiment to facilitate connection between the parts.

If wireline entry sub 110, as shown, includes a lower tubular gripping device 43, then tubular segment 46 may be gripped by device 43 before or after securing sub 110 under the top drive. For example, sub 110 may be secured onto tubular by raising the top drive in the drilling rig and vertically positioning the top drive until sub 110 is substantially vertically aligned with the stump of the tubular segment; lowering the top drive until lower tubular gripping device 43 is positioned adjacent, over or, in the present embodiment, in the upper end of the tubular segment and then driving the gripping mechanism of device 43 to engage tubular 46. This can be done without rotation of the body, which facilitates and speeds connection between the parts.

The sub may be installed so that it's center axis x is not angled or displaced from the center axis xd of tubular segment 46, but instead is substantially coincident therewith so that wireline 20 may pass into the drill string along a substantially straight line coincident with the center axis xd of tubular 46 and any string attached therebelow.

When entry sub 110 is secured on the upper end of a tubular segment, or supports and grips a tubular segment, the tubular segment and the entirety of any tubular string connected thereto may be lifted by raising the top drive unit and sub 110 with the rig drawworks. Accordingly, entry sub 110 is made of materials and has dimensions sufficient to give entry sub 110 sufficient tensile strength to lift a drill string. By way of example only, entry sub 110 may be made of high strength carbon steel, stainless steel, or other similar materials. The "straight-line" aspect of the tool, that is, the center or lift axis of entry sub 110 being substantially coincident with the center axis of a drill string, results in no undesirable bending moment or canting when a drill string is lifted with entry sub 10 in place.

If desired, a swivel bearing 194 may be incorporated above or below upper end 112 to prevent rotation from being conveyed from the top drive to the sub.

A positive flow control valve (commonly known in the industry as a "TIW" valve) may be placed below entry sub 110, to permit pressure isolation of the drill string while entry sub 110 along with wireline and wireline tools are rigged up.

If desired to facilitate handling, a wireline entry sub may include a transportation skid 195.

In certain operational situations where wireline operations are conducted under high pressure a wireline blow out preventer assembly (BOP) 196 may be employed in lower end 114 or may be positioned in a sub below sub 110, in addition to or alternately from any seal assembly in port 126. In the illustrated embodiment, assembly 196 is positioned in passage 126*a* immediately below port 126. Assembly 196 may offer well control during operation. A BOP assembly may include, for example, ram elements to seal around the wire, to seal the cavity when a wireline is not present and to cut the wire and seal the cavity, if necessary. In one embodiment, for example, the BOP may include a number of rams including, for example, a shear ram closable to cut the wireline and possibly seal thereabout, and one or more (top and/or bottom) rams, such as annular rams closeable about the wireline, for sealing pressure from above or below. The wireline BOP may be remotely controlled by an operator for the rig.

Figure 3:
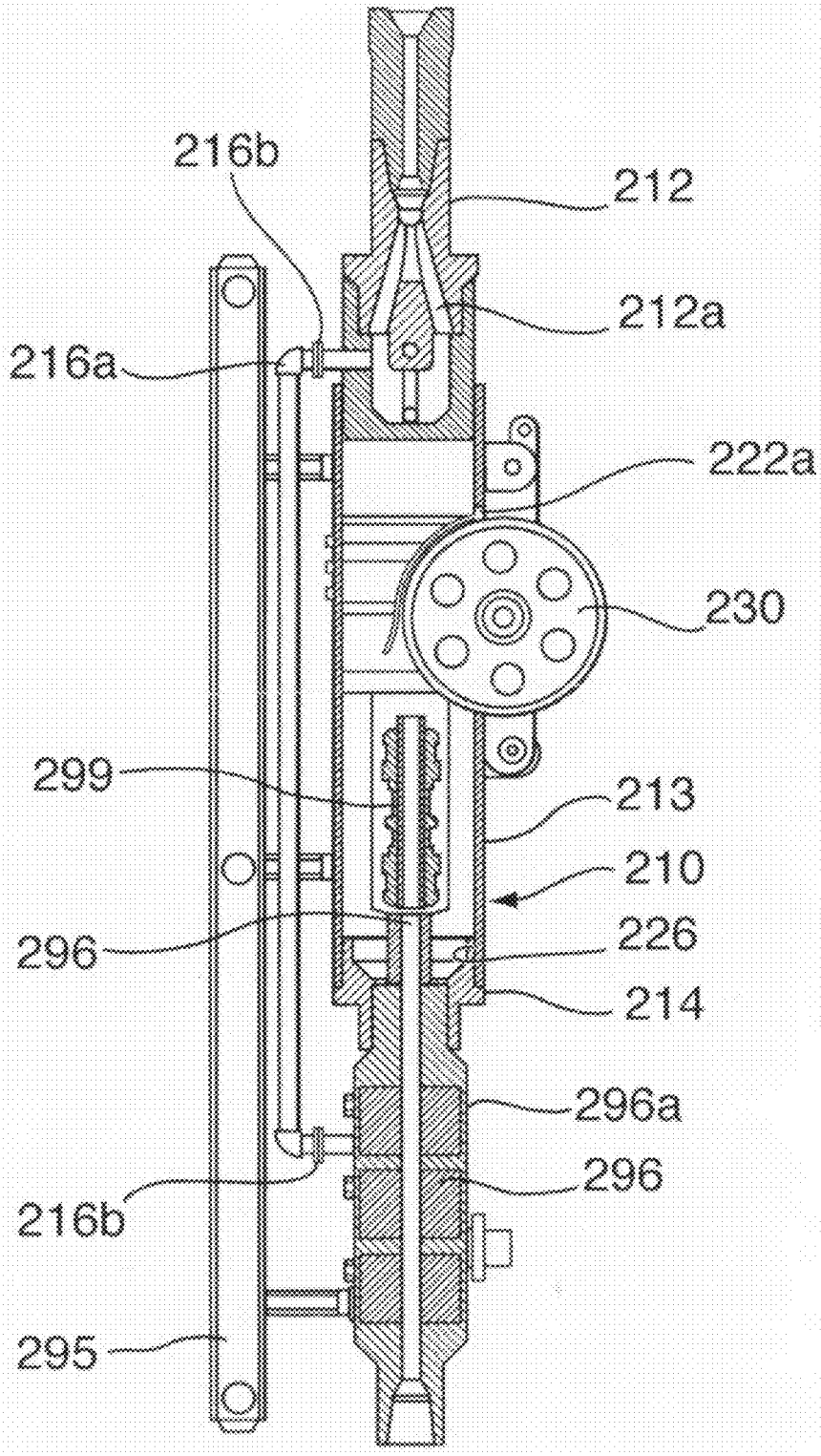
FIG. 3 is a sectional view along the center axis of another wireline entry sub according to the present invention.

FIG. 3 shows another wireline entry sub 210 according to one aspect of the present invention. Entry sub 210 is connectable between a top drive and a well bore tubular during use to permit the use of a wireline during a well bore operation. While the entry sub of FIG. 3 has many components similar to those described above, it does show some optional features not previously described. In this illustrated embodiment for example, wireline entry sub 210 includes a body formed of a plurality of connected parts. The body includes an upper end 212 and a hollow intermediate body 213 defining a lower end 214. A longitudinal, center axis may be defined extending between the upper end and the lower end.

In this illustrated embodiment, a fluid passage extends from a bore 212*a* in upper end 212 through an external line 216*a* that extends past lower end 214 to a blow out preventer 296 connected thereto. As such, line 216*a* acts to bypass lower end 214 of the entry sub such that its construction can be simplified. Line 216*a* is connected by couplings 216*b* such that the line can be easily disconnected, should that be required.

Entry sub 210 and blow out preventer 296 are mounted to a skid 295, which facilitates handling and strengthens the overall assembly. In this embodiment, the BOP housing 296*a* forms part of a structure to support the weight load of any tubulars connected therebelow. This differs from the embodiment of FIG. 2, wherein the BOP does not support any of the weight load of tubular segment 46 and any string attached thereto.

Entry sub 210 is formed to accept a wireline (not shown) passing from a source through entry sub 210 to, thereafter, pass through the blow out preventer and then downhole. In the illustrated embodiment, the entry sub hollow body portion includes slot 222*a* therethrough that provides access to the hollow interior of body portion 213 which together accommodate a portion of a sheave 230 therein. A wireline entry port is defined as an opening 226 at lower end 214. Opening 226 is sized to accept an upper ported end 296*a* of the blow out preventer housing into which the wireline can be inserted. A pack off 299 can be positioned in body portion 213 of the entry sub and connected, as by use of a hydraulic quick connect, to BOP 296 to provide a seal about the wireline above the blow out preventer.

Figure 4:
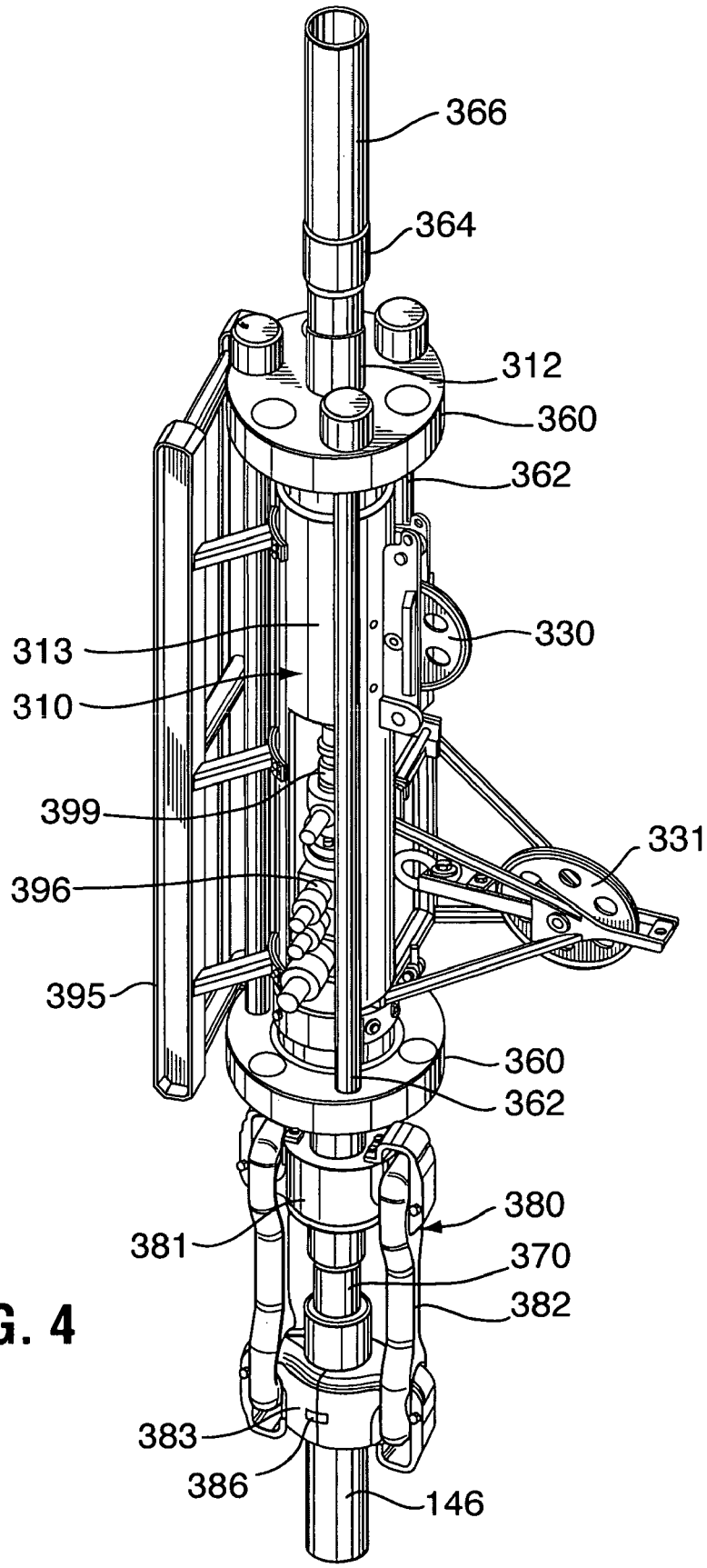
FIG. 4 is a perspective view from above of a portion of a well process assembly according to the present invention.
Figure 5:
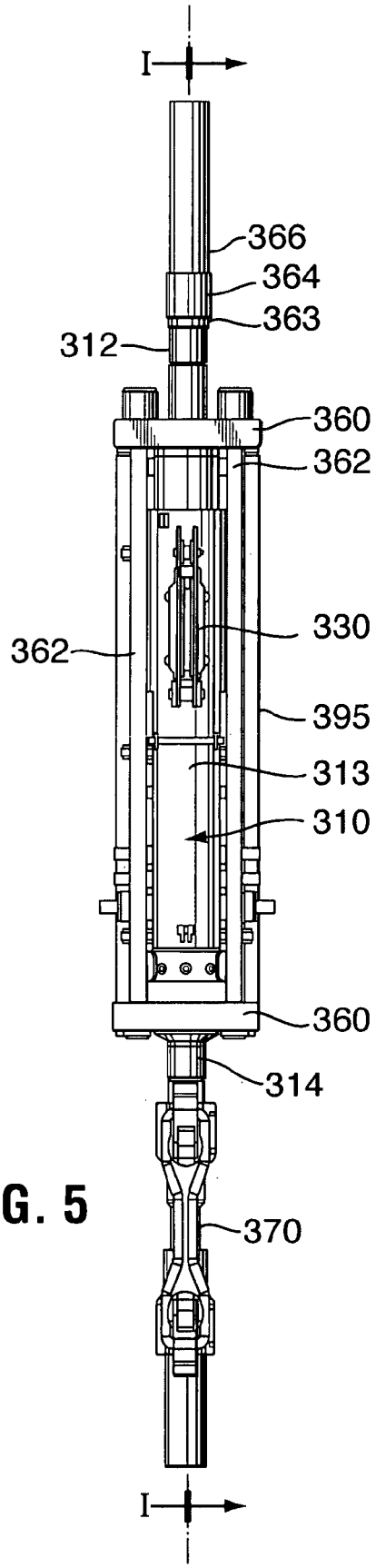
FIG. 5 is a front elevation of the assembly of FIG. 4.
Figure 6:
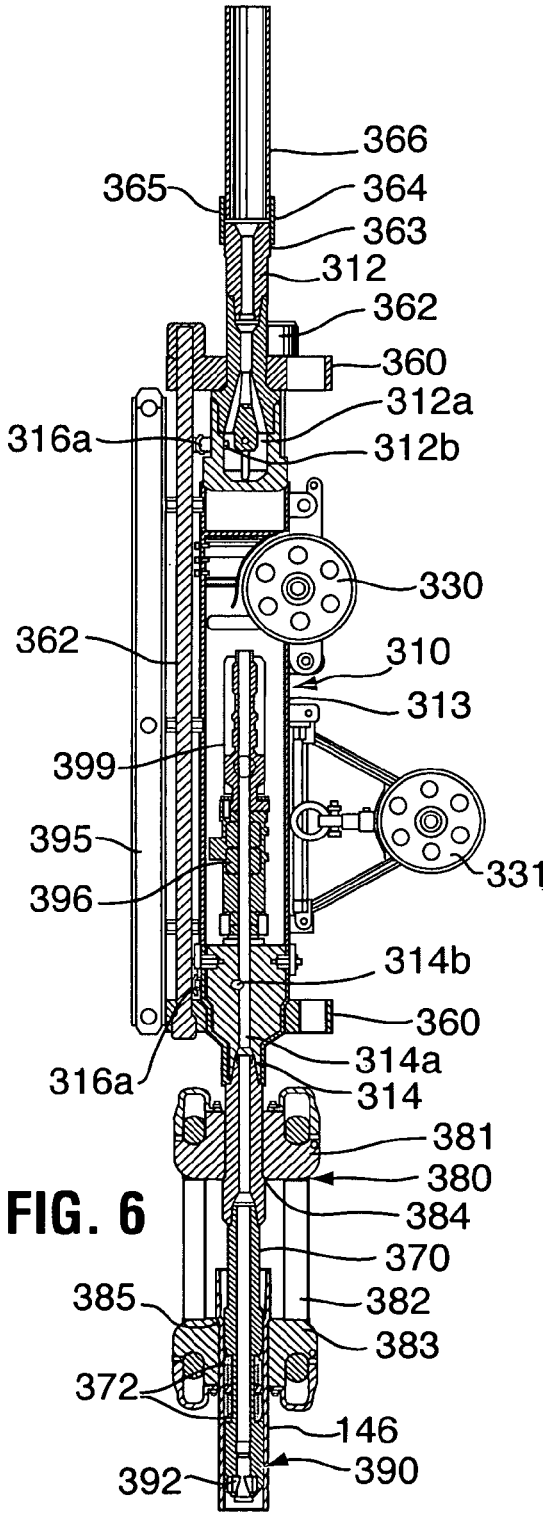
FIG. 6 is a sectional view along line I-I of FIG. 5.

With reference to FIGS. 4 to 6, another wireline entry sub 310 is shown as a portion of a well process system. Again, the embodiment of FIGS. 4 to 6 shows additional possible aspects of the invention.

In this illustrated embodiment for example, entry sub 310 is connectable between a top drive (not shown) and a well bore tubular during use to permit the use of a wireline (not shown) during a well bore operation. Wireline entry sub 310 includes a body formed of a plurality of connected parts that together define an upper end 312, a hollow intermediate body 313, a lower end 314 and an outer support assembly. A longitudinal, center axis may be defined extending between the upper end and the lower end.

The outer support assembly includes mounting flanges 360 secured adjacent the upper and the lower ends of the sub and structural support tie rods 362 mounted therebetween. The outer support assembly is selected to provide lateral strength to the sub and to transfer load between its ends. This strength and load transfer is provided while permitting access to the internal components. A skid 395 may be mounted to sub 310 to facilitate handling and further strengthen the overall assembly.

In this illustrated embodiment, a fluid passage extends from a bore 312*a* and lateral port 312*b* in upper end 312 through an external line 316*a* to a lateral port 314*b* and a bore 314*a* in the lower end. A pack off 399 and a blow out preventer 396 are installed in intermediate body portion 313 and together with bore 314*a* form a wireline passage through which a wireline may pass.

A first sheave 330 is mounted to direct a wireline roved thereabout between a source (not shown) and pack off 399. A second sheave 331 is installable on the sub to further direct the wireline if desired.

The wireline passage formed through pack off 399, blow out preventer 396 and bore 314*a* extends along the sub's center axis and sheave 330 is positioned on the sub to release wireline above and inline with the wireline passage so that any wireline passing therethrough extends in a straight line from the sheave out the bottom of the sub.

In this illustrated embodiment, upper end 312 is formed as a pup joint including a shoulder 363 formed by a casing-type coupling 364 and a length of a casing-type tubular 366, which together may be selected to resemble the form of tubulars normally handled by the top drive intended to be used with sub 310. Coupling 364 creates a shoulder resembling that of casing connection such that elevators can be used to pick up sub 310 and align it for gripping by a tubular gripping device on the top drive. The elevators may be carried by the top drive or by a casing handling system of a tubular gripping device installed on the top drive. Casing-type tubular 366 provides a length and an interior or exterior surface selected to be gripped by the tubular gripping device being used on the rig. Casing-type tubular 366 and coupling 364 may be formed removable from the sub, as shown by threaded connections 365, such that these components can be removed and replaced if they become damaged or to select their sizes such that casing-type tubular 366 and coupling 364 are suitable for engagement with the top drive, tubular gripping device and/or elevators with which the sub is to be used.

Also in this illustrated embodiment, lower end 314 is formed as a spear 370. With consideration as to the size of tubulars 146 to be handled, spear 370 may be selected to fit within the tubular inner diameter. A seal, such as may be provided by packer cups 372, may be carried on the spear to create a seal between the tubular inner diameter and the body of the spear such that fluid is prevented from passing upwardly therebetween out of tubular 146. A well control ring (not shown) can also be carried on the spear, if desired. The well control ring may be formed to be positioned into an annulus between the spear and the upper end of the tubular in which the spear is inserted.

In the embodiment of FIGS. 4 to 6, a catch-type tubular supporting device is provided by pipe elevators 380. Pipe elevators 380 in this embodiment include an upper elevator 381, links 382 and lower elevator 383. Upper elevator 381 is securable to spear 370, as by provision of an upset shoulder 384 on the spear. As with standard pipe elevators, lower elevator 383 may be selected to act against a shoulder 385 formed on the outer surface of the tubulars being handled, such as that formed between the outer surface of a joint of casing 146*a* and the end 146*b* of a casing coupling. Lower elevator 383 may be selected to be a slip-type elevator to reduce adverse load effects on the casing connection, if desired. Links 382 may be secured between the upper and lower elevators and may be sized to ensure that the spear may be positioned and held within the tubular being handled with seal 372 in a position to act against the tubular inner diameter. Wireline entry sub 310 supports tubular 146 by use of pipe elevators 380. In particular, any force to separate tubular 146 from spear 370 is reacted through and resisted by pipe elevators 380. To facilitate use of pipe elevators 380, at least lower elevator 383 may include a hinge and releasable lock 386 such that it is openable and securable about tubular 146.

Also in the illustrated embodiment of FIG. 6, the wireline entry sub includes a tool connector device 390 for engaging wireline tools at surface. With such an embodiment, wireline tools may be releasably secured to entry sub 310 so that the wireline tools may be handled together with the entry sub. For example, during tripping out tools, the tool connector device can operate as a tool catcher wherein the wireline tools may be engaged at surface and removed together with entry sub 310 as it is raised away from the tubular stump. During installation of wireline tools to the tubular string, the tools may be secured via the tool connector to the end of a wireline entry sub. During installation, the wireline entry sub can be installed in the rig, for example by being gripped at its upper end by a casing drive system. Then a wireline may be installed through the entry sub and a wireline tool string may be connected to the wireline and assembled while an upper end of the tool string is engaged by the tool connector device. Thereafter, the assembled tools may be inserted into the inner diameter of a tubular string supported in the rig and the entry sub may be connected to the stump of the tubular string. The wireline tools may be disconnected from the tool connector device, as by manipulating the tool connector device to release engagement with the wireline tools. The wireline tools may then be lowered into the well while being supported on the wireline.

The tool connector device may also act to facilitate tool handling. For example, at surface, either before insertion of the tool string into the tubing string or once the wireline tool string is pulled to the surface, the wireline entry sub is disconnected from the tubular string and spaced above the tubing string to provide access to the tool string for disassembly. The weight of the tool string may be several thousand pounds. If the weight of the tool string is supported by the wireline, a tilting moment may be created on the wireline entry sub and, since the lower end is not laterally supported by attachment to the tubular string, it would cause the end to move away from the wellbore centerline and inhibit assembly/disassembly of the tools. Supporting the weight of the tool string on a tool catcher may eliminate the tilting moment and keep the axial force aligned with the wellbore centerline to facilitate tool handling. Thus, the weight of the tool string is supported by the wireline for transportation through the tubular string, but by use of a tool catcher, the weight may be supported directly by the wireline entry sub structure for handling the tool string when the wireline entry sub is disengaged from the tubular string.

Tool connector device 390 may be installed on the end of a spear 370, as shown, or another device or portion of a device that has access to the interior bore of the tubular segment into which the wireline is being run. For example, with reference to FIG. 2 a tool connector may be installed on an end of tubular gripping device 43.

Figure 7:
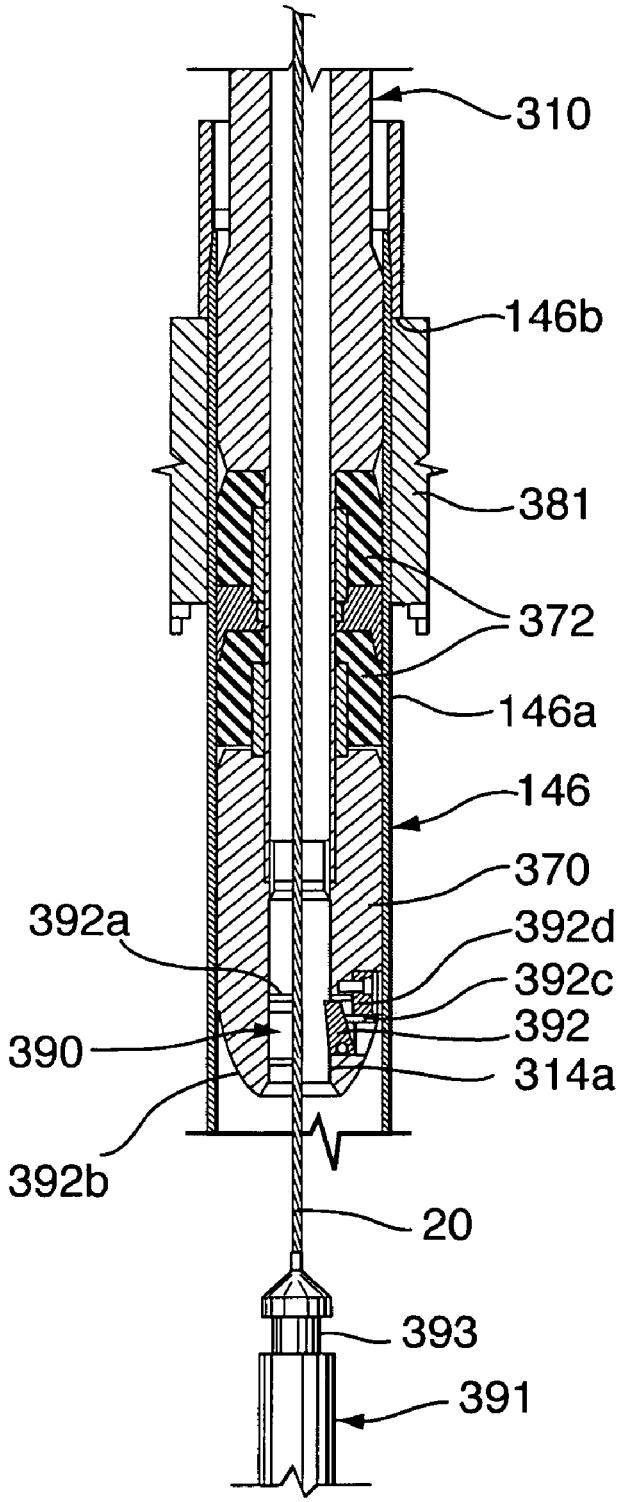
FIG. 7 is an enlarged portion of a tool connector useful on a wireline entry sub according to one aspect of the present invention.

An enlarged view of a mechanical tool connector device useful for a wireline entry sub is shown in FIG. 7. In this embodiment, tool connector device 390 is installed on a spear 370 of a wireline entry sub 310. Device 390 is selected to engage an enlarged member 391 of a tool or of a wireline connector. Device 390 and enlarged member 391 are formed to interlock as member 391 is pulled by wireline 20 into to the device. It will be appreciated that such an arrangement may include various engagement interacting mechanisms including for example, any of ratchet teeth, lock dogs, j-channel locks, detents, magnetic parts, etc. on one or both of the sub and the tool to be engaged. In the illustrated embodiment, device 390 includes one or more dogs 392 on spear 370 biased into bore 314*a*. Each dog 392 is formed to permit passage therepast upwardly of the tool end including a gland 393 but lock into the gland if it should attempt to pass downwardly over the dogs, which prevents the tool from passing downwardly out of engagement with the dogs. Each dog includes an upper end 392*a* creating a shoulder to engage in gland 393, a lower ramped side 392*b* formed to permit the tool to pass thereover and a biasing member 392*c*, such as a spring or a resilient member positioned to act between the spear body or an installation plug 392*d* and the dog. A dog 392 may be pushed against the biasing member to permit the tool to pass upwardly into bore 314*a* but will engage in gland 393 once the upper limit of the gland passes upper end 392*a* of the dog. Thus, a tool catcher may be used with a wireline entry sub to firmly engage a tool as it approaches the surface. Of course other approaches may become apparent such as, for example, the biasing member may be replaced with a biasing arrangement, such as by installing the dogs to fall by their own weight to project out into the bore.

The tool connector can be configured to be releasable to release engagement with a wireline tool string either by manual disengagement or remotely, when desired. For example, the installation plugs may be removed to access the biasing members. In another embodiment, where the tool connector is used to launch a tool, the tool connector may be releasable remotely, for example when the wireline tools and the tool connector are already installed in the tubular segment. In such an embodiment, an electrical, hydraulic or mechanical release actuator may be employed such as for example, a solenoid, a fluid pressure actuated dog release system, a fluid pressure driven system for overcoming the biasing load on the biasing members, etc.

Figure 8:
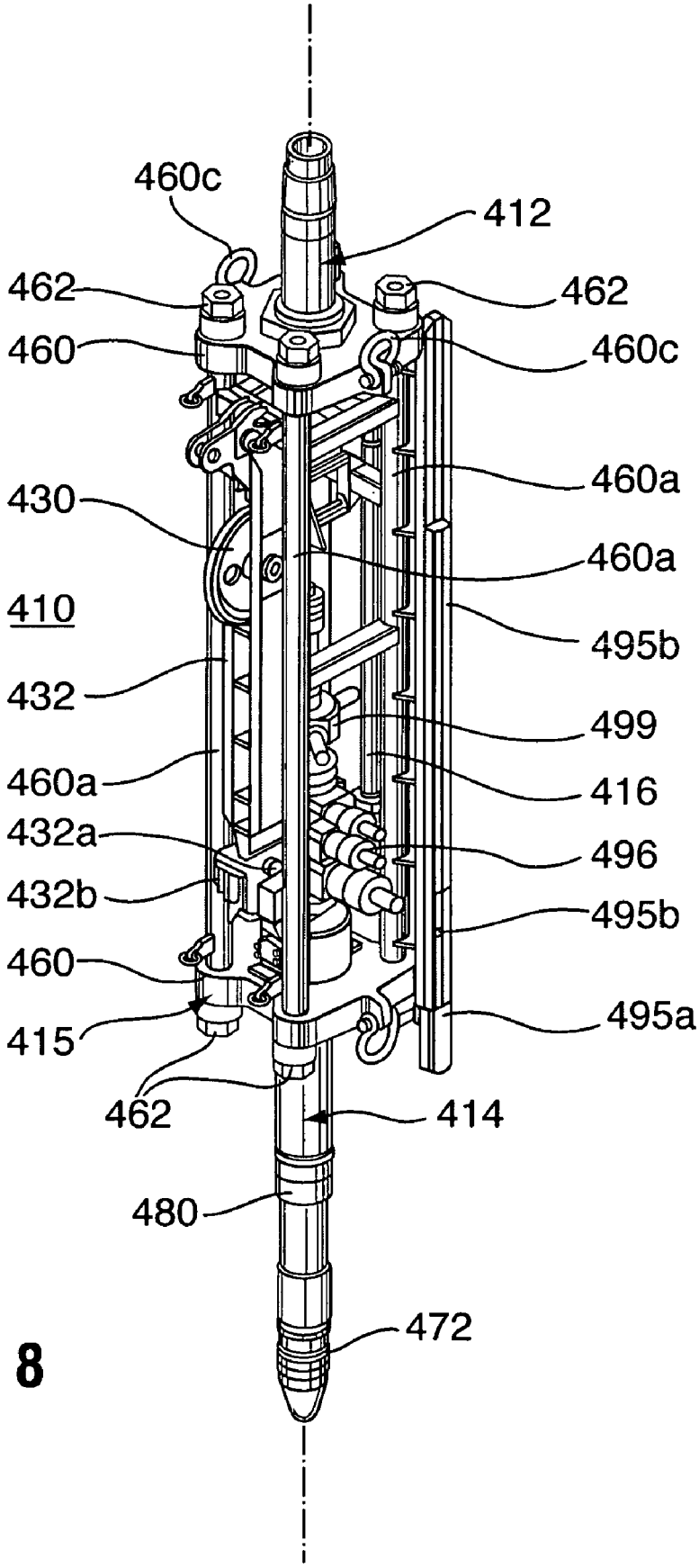
FIG. 8 is a perspective view from above of a portion of another wireline entry sub according to the present invention.
Figure 9A:
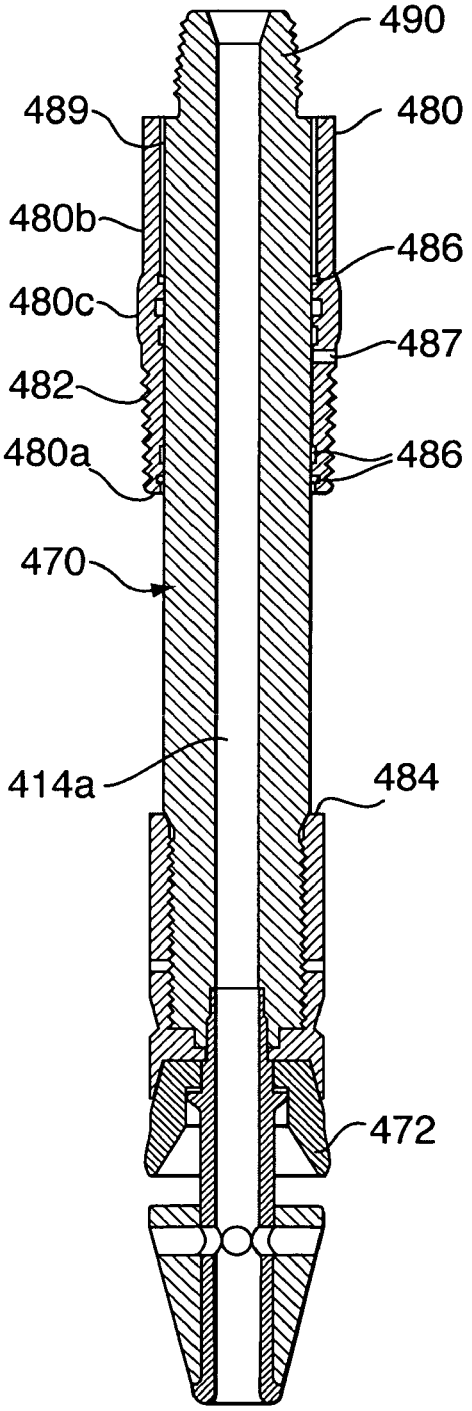
FIG. 9A is an enlarged sectional view along the center axis of a spear useful in the wireline entry sub of FIG. 8.
Figure 9B:
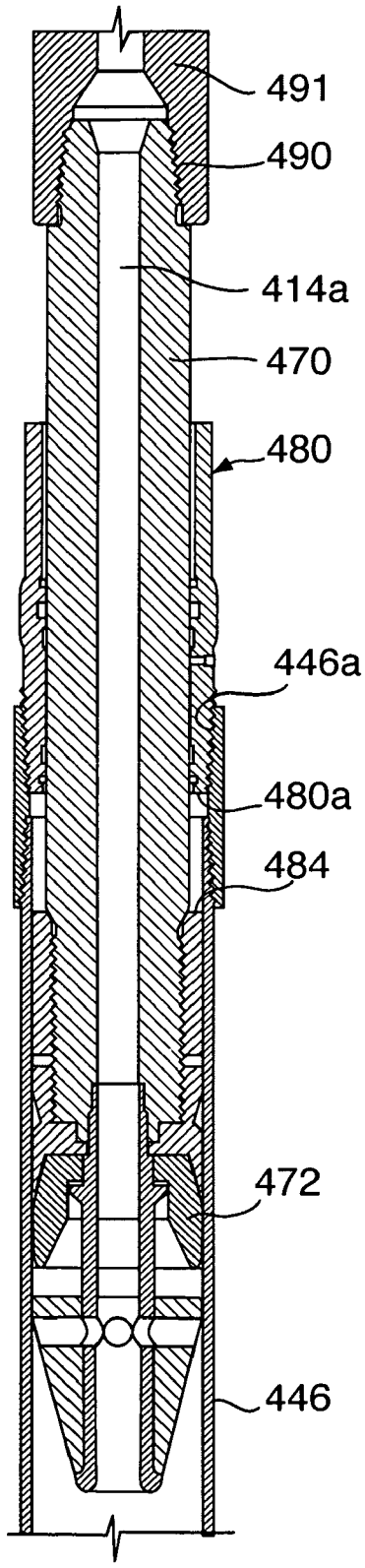
FIG. 9B is an enlarged sectional view along the center axis of the spear of FIG. 9A attached to wireline entry sub body and in use engaging a tubular.
Figure 10:
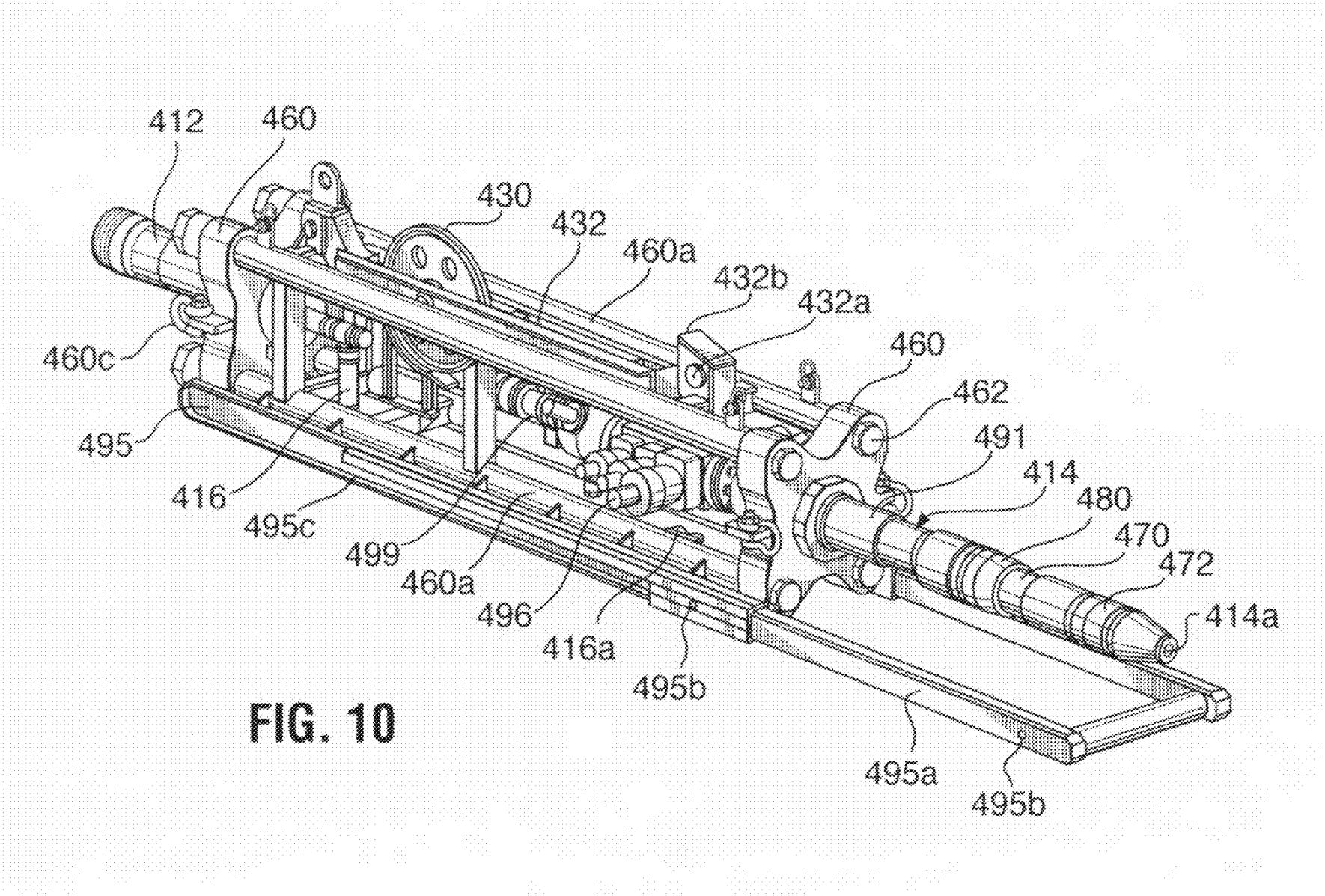
FIG. 10 is perspective view from below of the wireline entry sub of FIG. 8, with the frame in the extended position.

With reference to FIGS. 8 to 10, another wireline entry sub 410 is shown. Again, the embodiment of FIGS. 8 to 10 shows additional or alternate possible aspects of the invention.

In this illustrated embodiment for example, entry sub 410 is connectable to a well bore tubular 446 to permit the use of a wireline (not shown) during a well bore operation. Wireline entry sub 410 may be supported in the rig by a top drive or by other means. By selecting the angle of approach of the wireline, as by hanging the sub high up in the rig, the wireline entry sub may be used with a lateral support such as a torque track.

Wireline entry sub 410 includes a body formed of a plurality of connected parts that together define an upper end 412, a lower end 414, intermediate components between the upper end and the lower end and a support assembly 415. A longitudinal, center axis may be defined extending between the upper end and the lower end.

Support assembly 415 includes mounting flanges 460 and tie rods secured therebetween. Mounting flanges 460 may be secured adjacent or formed integral with the upper and the lower ends of the sub. In one embodiment, mounting flanges 460 and the tubular subs forming the upper and lower ends each include shoulders that permit load transfer therethrough. In the illustrated embodiment, tubular housings 460*a* may be supported between the mounting flanges, as by welding or threaded connections, and structural support tie rods extend through and are protected by tubular housings 460*a* and are secured by heads or nuts 462 at either end where they extend beyond flanges 460. Support assembly 415 provides lateral and axial strength to the sub and its components to transfer load between the ends. The primary load path for axial load, which may be significant, such as may require a 500 ton rating, is through ends 412, 414, tie rods, flanges 460 and nuts 462. However, support assembly 415 provides strength and load transfer while permitting full access to the intermediate components.

Support assembly 415 includes in part a skid frame 495 to facilitate handling, to protect and which may further strengthen the overall assembly. Skid frame 495 may be secured at a side of the entry sub such as by welding to tubular housings 460*a*. Skid frame 495 includes extendable bars 495*a* that may be extended (FIG. 10) to support and protect the lower end 414 during transport and handling. Extendable bars 495*a* may be stored (FIG. 8) by sliding or telescoping them into a portion of skid frame 495, for example into tracks 495*c*, when it is desired to move them out of the way for operation of end 414. Locks, such as detents 495*b* or pins, may be provided to hold the bars in their extended and stored positions.

For handling, eyes 460*c* may be provided to accept slings (not shown) for picking up the entry sub and positioning it below the top drive or draw works for use thereof. Any dragging of the entry sub that may be necessary over the rig floor may be accommodated by support assembly 415 and bars 495*a*.

In this illustrated embodiment, a fluid passage 416 extends along support assembly 415 between upper end 412 and lower end 414. The fluid passage includes a ball valve 416*a* in a position adjacent its connection to the lower end. The ball valve can be actuated to close the fluid passage to reduce leakage when the entry sub is lifted out of a tubular. Although most top drives include a fluid passage valve to stop mud flow out of the top drive, without a valve on the entry sub leakage of any fluid in the entry sub fluid passage may occur.

The intermediate components including, for example, a pack off 499, a blow out preventer 496 and a first sheave 430, mounted to direct a wireline roved thereabout between a source (not shown) and pack off 499, are installed and supported between the tubular housings and between the upper end and the lower end, but are open for manipulation thereof.

A wireline passage formed through pack off 499, blow out preventer 496 and a bore 414*a* through lower end 414 extends along the sub's center axis and sheave 430 is positioned on sub to release wireline above and inline with the wireline passage so that any wireline passing therethrough extends in a straight line from the sheave out the bottom of the sub.

Pack off 499 and BOP 496 may take various forms. For example, as noted above, the BOP may include various rams and may be driven in various ways. In one embodiment, the BOP is driven by fluid pressure and may include connections for pressure lines. Such connections may be accessible through the sub body. The BOP assembly may include thereabove one or more wipers. In one embodiment, a wiper element is installed above the BOP and includes one or more hydraulically driven rubber wiper elements operated from the BOP hydraulic control system. A drain hose may be provided to remove mud that is captured thereby. To clean the wire rope and collect any fluid that migrates through the pack off, an air wiper system may be installed above pack off 499. All or some of these well control and mud retaining components may be integrated into the wireline entry sub and may be accessible for operation and set up.

A sheave assembly including sheave 430 provides a second load path accommodating the loads in moving tools via a wireline. Sheave 430 is mounted on a bracket 432 including a hinged connection 432*a* so that the bracket and the sheave thereon can be rotated out to facilitate roving of the wireline. The length of the bracket between sheave 430 and hinged connection 432*a* may be extended to permit the sheave to be moved significantly away from the sub center axis. A longer length of bracket permits the sheave to be moved well away from the pack off and facilitates access thereto. A stop 432*b* may be provided relative to the hinged connection such that rotation about the hinge may be limited to prevent the sheave from dropping down against the entry sub.

Also in this illustrated embodiment, lower end 414 is formed as a spear 470. With consideration as to the size of tubular 446 to be handled, spear 470 and the components thereon may be selected to fit within the tubular inner diameter. A seal, such as may be provided by packer cup 472, may be carried on the spear to create a seal between the tubular inner diameter and the body of the spear such that fluid is prevented from passing upwardly therebetween out of tubular 446.

In the embodiment of FIGS. 8 to 10, a tubular supporting device is provided by a threaded sleeve 480. Threaded sleeve 480 in this embodiment is rotationally and axially moveable on spear 470 and includes a threaded interval 482 formed as a pin end selected to engage the threaded box 446*a* of a tubular 446 to be handled. Spear 470 includes a lower, upward facing shoulder 484 that limits the lower axial travel of sleeve 480 on the spear by abutment of lower end 480*a* of the sleeve against the shoulder. Shoulder 484 can support the sleeve and accepts the transfer of any load from tubular 446 and sleeve 480 to the body of the spear. When lower end 480*a* is resting on shoulder 484, such as when an axial load is applied, rotation of the sleeve about spear 470 is resisted by frictional interference between the sleeve's lower end and the shoulder. Since rotation of the casing may interfere with wireline activities, any rotation of the casing supported on the sleeve is desirably limited.

Lower shoulder 484 creates an increase in the spear's effective outer diameter therebelow and may be formed by a collar having an outer diameter greater than that of the spear body thereabove and may be secured, as by threading (as shown), welding, etc., to the spear or by forming the shoulder into the material of the spear.

Sleeve 480 may include inner annular seals 486 and a grease fitting 487 to ensure that sleeve remains lubed on the spear and able to easily rotate about, and travel axially along, the spear body. In one embodiment, the seals may include one or more pressure seals and/or wiper seals.

Sleeve 480 permits the wireline entry sub 410 to be secured to and to support tubular 446 without requiring relative rotation between the main body of the sub and the tubular to be supported on the sub. In particular, spear 470 may be inserted into the stump of tubular 446 and when shoulder 484 passes through threaded box 446*a*, sleeve 480 can be rotated about the spear to thread its threaded interval 482 into the box. Rotation of the sleeve may be driven by external torque application devices such as manually by rig personnel, chains, chain tongs, manual casing tongs (rig tongs), an iron rough neck, etc. Sleeve 480 includes an upper end 480*b* above threaded interval 482, which provides a substantially cylindrical surface with a crush resistance to enable the sleeve to be gripped and rotated by torquing devices used for casing connections or tool joints on the rig. Sleeve 480 may be formed such that an annular gap 489 is formed between the spear outer surface and the sleeve inner diameter at upper end 480*b*. Gap 489 provides a space to accommodate any deflection in the sleeve during gripping and rotation thereof, to prevent the sleeve from ceasing against the spear during this operation. Sleeve 480 may include a radially thickened region 480*c* that creates an annular protrusion between threaded interval 482 and upper end 480*b* to facilitate placement of the torqueing devices on the upper end while avoiding placement of the device on the threaded interval.

After the sleeve is threaded into tubular 446, the entry sub can be raised up, which causes the sleeve to slide axially down until it is supported against lower shoulder 484. Thereafter, once tubular 446 is released from the rig floor, the weight of the tubular will be supported through sleeve 480 by shoulder 484 and, therefore, the weight of the tubular is transferred to the entry sub and the top drive thereabove.

To repair or replace sleeve 480, the collar forming shoulder 484 and the components therebelow may be removed from the spear and the sleeve may be slid off the spear. The spear can be removed from the remaining body of the wireline entry sub, as desired, such as by threaded engagement between a pin end 490 and a threaded box 491 on the wireline entry sub.

A wireline entry sub may be useful during operations where it is desired to rig up to use wireline, such as for installing or retrieving a downhole tool such as in casing drilling operations. There are various methods which may be used to move the entry sub to a supported position in the rig. In one useful method and using the sub of FIGS. 8 to 10 as an example, entry sub 410 may be positioned on a catwalk adjacent the catwalk ramp to the rig floor. The entry sub may be positioned on skid frame 495 with extendable bars 495*a* out in an extended position to protect the spear. At this point, the wireline can also be inserted about sheave 430, through pack off/BOP 499, 496 and through the remaining wireline passage. To do so, various components may be accessed such as the pack off and BOP through the support assembly and sheave may be moved on bracket 432 and hinged connection 432*a*. The wireline can also be strung through sheaves on the rig floor or catwalk. Of course, the wireline can be inserted to the entry sub at other points in time, as desired, but such handling off the rig floor offers a time and space benefit.

The wireline entry sub can then be picked up and hoisted from the catwalk to the rig. To do so, slings may be installed through lugs 460*c* and one or more winches or cranes may be employed to pull the entry sub up into the rig, while others may be employed, if desired, to hold the sub back and control its movement against impacting against portions of the rig and/or adjacent structures. Lines may be connected to the entry sub at various points for this purpose. Of course, a mechanized pipe handling system may alternately be used to move the entry sub closer to the rig floor prior to hoisting same.

When the entry sub is hoisted and hanging over a casing stump in the rig, extendable bars 495*a*, if any, may be moved to the retracted position such that they no longer obstruct access to the spear. To do so, a winch or crane may be used to pull the bars up until the locks 495*b* can be actuated to hold the bars 495*a* in the retracted position.

Thereafter, end 414 of the wireline entry sub may be lowered into the stump. If desired, sleeve 480 may be threaded loosely, as by hand tightening or chain tongs, into the stump's threaded box. In this position, the rig's top drive may be lowered to engage the entry sub. In one embodiment, the rig may include a top drive with a tubular gripping device therebelow and the tubular gripping device may be employed to engage the wireline entry sub and support it below the top drive. If necessary or desired, lines may be employed to stabilize the upper end of the wireline entry sub during this operation. The wireline entry sub may be secured by safety slings to a structure thereabove. For example, a sling may be installed about mounting flange 460 adjacent upper end 412 and connected thereabove, such as to the top drive. At this point, fluid connections to the BOP and pack off may also be made.

Wireline entry sub 410 may then be backed out of the casing stump, by unthreading sleeve 480, if necessary, and lifting the top drive. Wireline tools can then be installed on the wireline extending from the lower end of entry sub 410. The wireline tools and entry sub 410 can be lowered into the stump and interval 482 of the sleeve can be threaded into box 446*a* of the stump. The threaded connection between the sleeve and the stump can then be made up to a torque specification as is required to support the load of the stump and the string weight therebelow. Thereafter, the weight of the string can be picked up from the rig and the load thereof may be supported through the sleeve to shoulder 484 of the wireline entry sub and through the wireline entry sub support assembly 415 to the tubular gripping device and top drive.

The casing can be reciprocated up and down in the well and circulated therethrough, as required. The wireline and attached tools can be run in and out of the well by use of the wireline entry sub as driven by traction winches etc. to which the wireline is connected.

Although various aspects of the invention have been described herein, it is to be understood that not all aspects need be employed together. For example, a wireline entry sub according to the present invention may be used with any or all of a power drive assembly, an upper tubular gripping device, an upper end formed for engagement with a tubular gripping device, a tubular supporting device on its lower end, a spear, a skid, an integrated BOP, a tool connector and/or various other features and options described herein.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A well process sub for securing between a top drive of a drilling rig and string of pipe that has a threaded upper end, comprising:

a body including an upper end adapted to be lifted by the top drive, a lower end and a longitudinal, center axis therebetween;

a spear extending downward from the lower end of the body, a portion of the spear having an outer diameter selected for insertion into the string of pipe;

an external upward-facing shoulder on the spear having an outer diameter sized for reception in the string of pipe; and a sleeve axially and rotatably moveable on the spear above the upward facing shoulder, the sleeve including a threaded interval thereon for threaded engagement with the threaded upper end of the string of pipe, the sleeve having an external downward-facing shoulder, such that lifting the body with the top drive causes the spear to move upward within the string of pipe until the upward facing shoulder abuts the downward-facing shoulder, which causes the string of pipe to be lifted.

2. The well process sub of claim 1 wherein the threaded interval is on an exterior portion of the sleeve.

3. The well process sub of claim 1 wherein the sub has a fluid passage extending from an upper end of the body through a lower end of the spear for pumping fluid down the string of pipe, and the sub further comprises:

an annular seal positioned around the spear between the sleeve and the lower opening for sealing against an inner diameter of the string of pipe.

4. The well process sub of claim 3 wherein the annular seal comprises a downwardly facing packer cup.

5. The well process sub of claim 1 wherein:

the sleeve has an upper portion above the threaded interval with a cylindrical exterior for being gripped by a torque device to tighten the sleeve to the string of pipe; and the upper portion has an inner diameter larger than an outer diameter of the spear, defining a gap between the upper portion of the sleeve and the spear.

6. The well process sub of claim 1 further comprising an annular seal acting between the sleeve and the spear, the annular seal being moveable with the sleeve.

7. The well process sub of claim 1, wherein:

the threaded interval is on an exterior of a lower portion of the sleeve;

a cylindrical surface is on an exterior of an upper portion of the sleeve for engagement by a torque tool to tighten the sleeve to the string of pipe; and an annular band having a diameter larger than the cylindrical surface and the threaded interval is located between the cylindrical surface and the threaded interval.

8. A well process sub for connection between a top drive of a drilling rig and a string of pipe having an internally threaded upper end, comprising:

a body including an upper end, a lower end and a longitudinal, center axis therebetween, the body adapted to be lifted by the top drive;

a spear rigidly attached to and extending downward from the body, a lower portion of which is adapted to insert into the string of pipe;

a fluid passage extending through the sub from an upper end of the sub to a lower end of the spear for pumping fluid down the string of pipe;

an upward facing shoulder on an exterior portion of the spear, the upward facing shoulder adapted to be inserted into the string of pipe;

a sleeve axially and rotatably moveable on the spear above the upward facing shoulder, the sleeve including an externally threaded interval for threaded engagement with an internally threaded upper end of the string of pipe;

the sleeve having an upper portion above the threaded interval that is cylindrical for being gripped and rotated by a torque device to rotate the sleeve relative to the spear into threaded engagement with the threaded upper end of the string of pipe;

the sleeve having a first position wherein a lower end of the sleeve is spaced axially above the upward facing shoulder, the threaded interval is in engagement with the threaded upper end of the string of pipe, and the weight of the string of pipe is being supported by the drilling rig;

the sleeve having a second position wherein a lower end of the sleeve is in abutment with the upward facing shoulder, the sub is being lifted by the top drive, and the weight of the string of pipe is supported by the sub;

a seal between the spear and the sleeve; and a seal on an exterior of the spear below the upward facing shoulder for sealing against an inner diameter of the string of pipe.

9. The well process sub of claim 8 wherein the upper portion of the sleeve has an inner diameter larger than an outer diameter of the spear, defining a gap between the upper portion of the sleeve and the spear.

10. The well process sub of claim 9 further comprising an annular band having a diameter larger than the cylindrical surface and the threaded interval, the band being located between the cylindrical surface and the threaded interval.

11. The well process sub of claim 8 further comprising:

a wireline entry port in the body below the upper end of the body for inserting a wireline into the string of pipe; and a sheave mounted to the body for guiding the wireline into the entry port.

12. A method for installing a well process sub between a top drive of a drilling rig and a string of pipe extending into a well, the sub including a body having an upper end, a lower end and a longitudinal, center axis therebetween, the sub having a spear extending downward from the body, the string of pipe being accessible as a stump secured at a rig floor of the drilling rig, and the stump including a threaded upper end, the method comprising:

providing an upward facing shoulder on the spear;

mounting on the spear above the upward facing shoulder a sleeve having a threaded interval, the sleeve being rotatable and axially movable relative to the spear, the sleeve having a downward facing shoulder;

with the top drive, inserting a lower portion of the spear, including the upward facing shoulder, into the stump; then rotating the sleeve relative to the spear to thread the sleeve into the threaded upper end of the stump, which positions the downward facing shoulder of the sleeve a distance above the upward facing shoulder of the spear; then with the top drive, lifting the sub, which cause the sub and spear to move upward relative to the sleeve and the stump until the downward facing shoulder of the sleeve abuts the upward facing shoulder of the spear, and continued lifting lifts the string of pipe.

13. The method of claim 12 further comprising: sealing between the spear and an inner diameter of the string of pipe;

sealing between the sleeve and the spear; and pumping fluid down the sub, out the spear and down the string of pipe.

14. The method of claim 12 wherein:

the string of pipe comprises a string of casing; and the threaded upper end comprises a casing collar having internal threads.

15. The method of claim 12 wherein rotating the sleeve comprises gripping a cylindrical portion of the sleeve above the threaded interval.

16. The method of claim 12 further comprising:

providing a wireline passage through the body with an entry port below the upper end of the body and an outlet at a lower end of the spear; and before inserting the spear into the stump, inserting a wireline through the entry port and wireline passage and out the lower end of the spear; then connecting a wireline tool to the wireline and inserting the wireline tool into the string of pipe; then inserting the spear into the stump and rotating the sleeve to connect the sleeve to the threaded upper end of the string of pipe.

17. The method of claim 16 further comprising pumping fluid down the sub and into the string of pipe while the wireline tool is located within the string of pipe.

18. The method of claim 17 further comprising, with the top drive, raising and lowering the sub and the string of pipe while pumping fluid down the string of pipe with the wireline tool located therein.

* * * * *